US005771732A

United States Patent [19]

Krämer et al.

[11] Patent Number: 5,771,732

[45] Date of Patent: Jun. 30, 1998

[54] STECKEL MILL

[75] Inventors: Stephan Krämer, Hilchenbach; Dieter Rosenthal, Niederfischbach; Peter Sudau, Hilchenbach, all of Germany

[73] Assignee: SMS Schloemann-Siemag Aktiengesellschaft, Dusseldorf, Germany

[21] Appl. No.: 635,065

[22] Filed: Apr. 19, 1996

[30] Foreign Application Priority Data

Apr. 19, 1995 [DE] Germany ..... 195 14 475.9

[51] Int. Cl.[6] ..... B21B 27/06; B21B 41/06

[52] U.S. Cl. ..... 72/202; 72/200; 72/229; 72/8.8; 72/8.5

[58] Field of Search ..... 72/200, 201, 202, 72/229, 12.2, 12.5, 11.5, 11.2, 8.5, 8.8

[56] References Cited

U.S. PATENT DOCUMENTS 4,559,819 12/1985 Deppe et al. ..... 72/12.5

OTHER PUBLICATIONS

Patent Abstracts of Japan, vol. 009, No. 057 (M–363), Mar. 13, 1985 & JP–A–59 191502 (Hitachi Seisakusho KK), Oct. 30, 1984.

Database WPI, Section Ch, Week 8049, Derwent Publications Ltd., London, GB; Class M21, AN 80–87823C & SU–A–728955 (Filatov A S), Apr. 30, 1980.

Patent Abstracts of Japan, vol. 016, No. 474 (M–1319), Oct. 2, 1992 & JP–A–04 172104 (Hitachi Ltd; Others: 01) Jun. 19, 1992.

*Primary Examiner*—Lowell A. Larson
*Assistant Examiner*—Rodney Butler
*Attorney, Agent, or Firm*—Friedrich Kueffner

[57] ABSTRACT

A Steckel mill or coiler rolling mill includes at least one reversing stand and drivers and coiler furnaces arranged on the entry side and the exit side of the reversing stand, wherein the reversing stand, the drivers and the coiler furnaces are connected to one another through roller conveyors for the strip to be rolled. At least one heating unit is provided in at least one of the sections formed between the coiler furnaces and the reversing stand, wherein the heating unit covers at least a portion of the section.

7 Claims, 1 Drawing Sheet

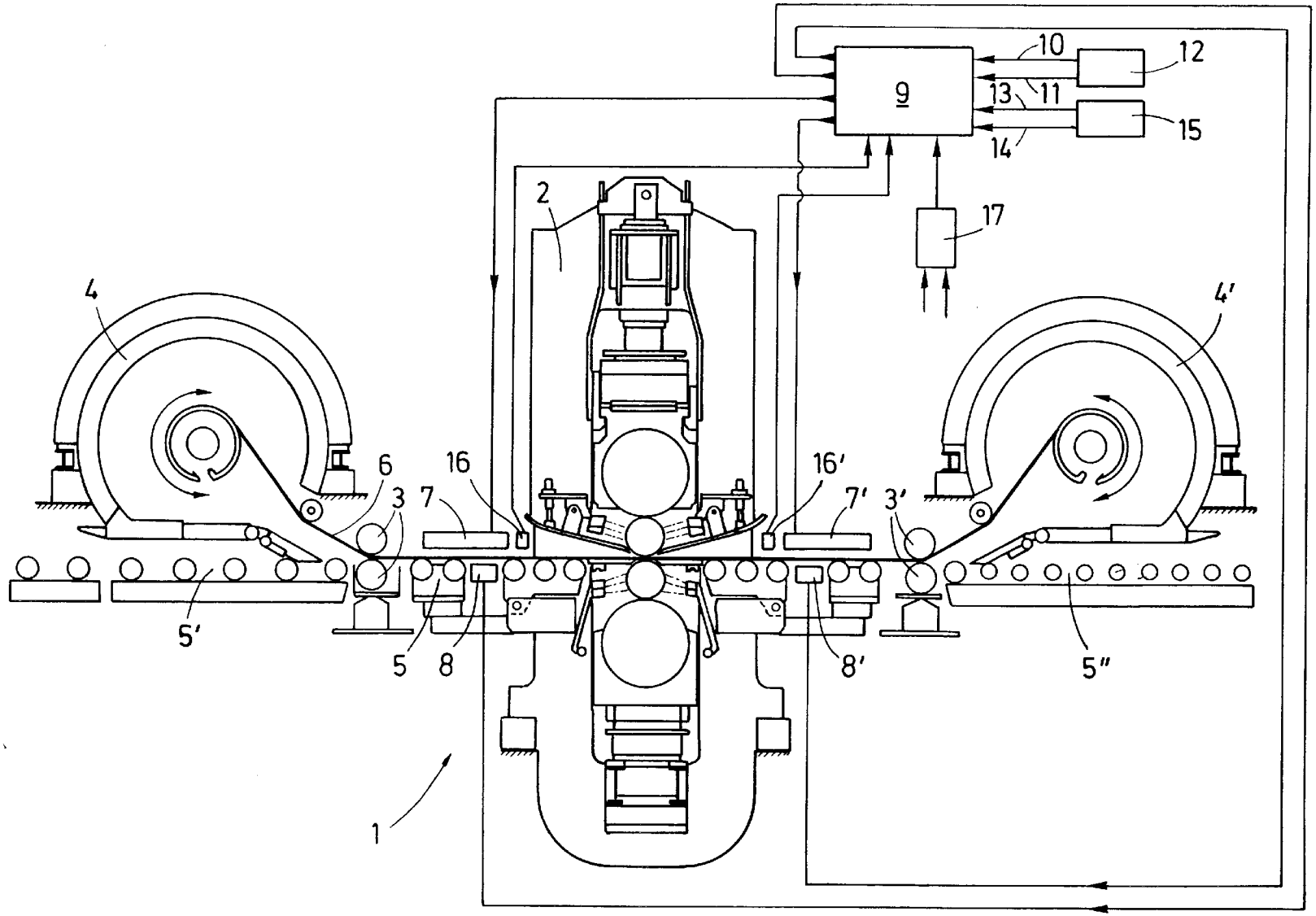
12
15
10
11
13
14
9
17
4'
5''
3'
7'
16'
8'
2
16
7
8
5
3
6
1
5'
4

STECKEL MILL

BACKGROUND OF THE INVENTION

1. Field of the Invention

The present invention relates to a Steckel mill or coiler rolling mill with at least one reversing stand and drivers and coiler furnaces arranged on the entry side and the exit side of the reversing stand, wherein the reversing stand, the drivers and the coiler furnaces are connected to one another through roller conveyors for the strip to be rolled.

2. Description of the Related Art

Steckel mills of the above-described type have long been known in the art. They operate as follows. The prerolled strip is introduced into the reversing stand under the coiler furnace on the entry side and through the driver on the entry side. After the first pass, the rolling stock is introduced into the coiler furnace on the exit side. After the start of coiling of the strip in the coiler furnace on the exit side, a predetermined strip tension is applied between the coiler furnace and the reversing stand and the strip is rolled at the appropriate speed. When the strip end enters the Steckel mill, the plant is decelerated to such an extent that the strip end comes to a standstill behind the roll gap of the reversing stand but in front of the driver on the exit side. During the reversing operation, the roll gap is adjusted for the next pass. The driver on the exit side introduces the strip into the reversing stand for beginning the next pass. After the beginning of the second pass, the strip is introduced into the coiler furnace on the entry side. At the end of the second pass, the strip beginning comes to a standstill between the driver on the entry side and the reversing stand.

During the reversing operation which, as described above, includes the steps of decelerating the strip, runout of the strip from the coiler furnace, reversing the strip, beginning the next pass and introducing the strip into the coiler furnace, the strip end as well as the strip beginning are cooled to a greater extent as compared to the middle portion of the strip. The increased cooling is caused by the fact that these strip portions are alternatingly not maintained at a high temperature in the coiler furnaces during the reversing operation. At least during the first passes, an additional cooling occurs at the strip beginning and at the strip end when these strip portions are wound onto a cooled mandrel of the coiler furnace which is adjusted to a certain temperature.

Due to the cold portions at the beginning and the end of the strip, the rolling force increases substantially during the pass as compared to the middle portion of the strip. Accordingly, the reversing stand must be designed for the high rolling forces occurring as a result. Because of extreme peaks of the rolling force at the cold portions at the beginning and end of the strip, changes in thickness and/or planeness of the strip can occur over the length of the strip. Accordingly, the rolling stock has a lower quality or relatively large quantities of scrap are produced.

SUMMARY OF THE INVENTION

Therefore, it is the primary object of the present invention to further develop a Steckel mill of the above-described type in such a way that no significant variations in the rolling force occur over the length of the strip, and that the strip is rolled with uniform quality and scrap is avoided.

In accordance with the present invention, at least one heating unit is provided in at least one of the sections formed between the coiler furnaces and the reversing stand, wherein the heating unit covers at least a portion of the respective section.

The solution proposed in accordance with the present invention provides the result that especially that portion of the strip which is not located within the heated coiler furnace can be raised to a temperature corresponding to the temperature of the remaining strip, so that the rolling force is not subject to large variations at least with respect to the temperature pattern over the length of the strip.

In accordance with a further development of the present invention, a heating unit is provided on each side of the reversing stand, so that not only the temperature of the strip beginning coming to a standstill in front of the reversing stand can be maintained at the desired level, but also the temperature of the strip end coming to a standstill behind the reversing stand.

As a rule, the drivers on the entry side and the exit side are arranged very closely to the respective coiler furnaces, so that the arrangement of the heating units between the drivers and the reversing stand is completely sufficient.

For quickly and reliably heating the strip beginning and the strip end, heating units can be provided above the roller conveyors as well as below the roller conveyors. If heating units are provided above and below the roller conveyors, it is advantageous to use the heating units individually as required or to use all heating units together for heating the strip.

The heating processes can be controlled particularly simply and accurately if, in accordance with another proposal, the heating unit is an induction heating unit.

In accordance with another feature of the present invention, the heating unit includes a control device which is provided with the desired values of the strip temperature and the actual values of the strip temperature. This heating unit has the advantage that not only the strip beginning and the strip end can be heated as required, but also cold portions within the strip can be recognized and heated if the temperature thereof is below the predetermined desired value of the strip temperature. As is conventional in control technology, it is useful to permit a certain band width of the actual values of the strip temperature, so that the heating unit does continuously switch on and off already at very small strip temperature variations.

In accordance with another feature, a position-dependent heating of the strip, as well as a combination of the control of the heating unit in dependence on the strip position and the strip temperature is possible.

If a switching device is provided which activates only that heating unit which is arranged in the respective strip travel direction in front of the reversing stand, it is ensured that the strip is appropriately heated prior to the pass in the reversing stand, while the strip emerging from the reversing stand is not subjected to a heating process.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic sectional view of a Steckel mill according to the present invention.

DESCRIPTION OF THE PREFERRED EMBODIMENT

FIG. 1 of the drawing shows a Steckel mill or coiler rolling mill 1. The mill 1 is composed of a Steckel roll stand 2, two drivers 3, 3', two coiler furnaces 4, 4' and a roller conveyor 5 which connects the rollstand 2 to the drivers 3, 3' and the coiler furnaces 4, 4'. A roller conveyor 5' has the purpose of supplying the strip 6 to the rolling mill 1 and another roller conveyor 5" has the purpose of removing the strip 6 from the rolling mill 1.

Heating units 7, 7' and 8, 8' are provided above and below the roller conveyor 5 between the drivers 3, 3'. These heating units 7, 7'; 8, 8' are connected to outputs of a control device 9. The desired value of the strip temperature can be supplied to the control device 9 through the input line 10 from a computer 12 and the desired value of the strip position can be supplied through the input line 11 to the control device 9 from the computer 12. However, these desired values can also be supplied from an input unit 15 through input lines 13, 14.

The actual values of the strip temperature are supplied to the control device 9 from the actual value sensors 16, 16' of the strip temperature, while the actual values of the strip position can be supplied to the control device 9 through a strip tracking device 17 which receives its various input signals from sensors arranged in the rolling mill at determining positions, not shown.

Accordingly, in dependence on the strip temperature and/or the strip position and/or the strip travel direction, the control device 9 regulates the heating power as required between zero and maximum power.

While specific embodiments of the invention have been shown and described in detail to illustrate the inventive principles, it will be understood that the invention may be embodied otherwise without departing from such principles.

We claim:

1. Steckel mill comprising at least one reversing stand having an entry side and an exit side for strip to be rolled, drivers and coiler furnaces arranged on the entry side and the exit side of the reversing stand, and a roller conveyor for the strip to be rolled for connecting the reversing stand with the drivers and the coiler furnaces, least one heating unit between the coiler furnaces and the reversing stand arrange at least one of above and below the roller conveyor, further comprising a control device configured for influencing a heating power of the at least one heating unit in dependence on a strip temperature and a strip position said dependence upon said strip position being irrespective of the direction in which the strip travels between said coiler furnaces.

2. The Steckel mill according to claim 1, where in the at least one heating unit is an induction heating unit.

3. The Steckel mill according to claim 1, wherein the control device is configured for influencing the heating power of the at least one heating unit in dependence on the strip temperature and the strip position and a travel direction of the strip.

4. The Steckel mill according to claim 1, further comprising actual strip temperature sensors between the drivers and the reversing stand, a strip tracking device for the mill, wherein a control device is arranged on the entry side of the reversing stand as well as on the exit side of the reversing stand, further comprising a computer and an input unit, and means for supplying a desired temperature value of the strip to the control devices from at least one of the computer and the input unit, and means for supplying at least one of actual strip temperature values from the actual temperature sensor to the control devices and strip position values from the tracking device to the control devices.

5. The Steckel mill according to claim 1, wherein the control device is configured for influencing the heating power of the at least one heating unit in dependence on the strip position.

6. The Steckel mill according to claim 1, wherein the control device is configured for influencing the heating power of the at least one heating unit in dependence on the travel direction of the strip.

7. The Steckel mill according to claim 4, further comprising a switching device for activating the heating device located in front of the reversing stand in strip travel direction.

* * * * *